US007229072B2

(12) United States Patent
DiFrancesco, Jr.

(10) Patent No.: US 7,229,072 B2
(45) Date of Patent: Jun. 12, 2007

(54) PLAYING SURFACE FOR A GAME AND METHOD OF USING A GAME PLAYING SURFACE

(76) Inventor: Anthony DiFrancesco, Jr., 6565 Main St., Williamsville, NY (US) 14221

( * ) Notice: Subject to any disclaimer, the term of this patent is extended or adjusted under 35 U.S.C. 154(b) by 0 days.

(21) Appl. No.: 11/240,295

(22) Filed: Sep. 30, 2005

(65) Prior Publication Data

US 2006/0066042 A1 Mar. 30, 2006

Related U.S. Application Data

(60) Provisional application No. 60/614,536, filed on Sep. 30, 2004.

(51) Int. Cl.
*A63F 7/00* (2006.01)

(52) U.S. Cl. ..... 273/118 R; 273/127 B

(58) Field of Classification Search ..... 273/118 R, 273/118 A, 119 R, 119 A, 127 R, 127 B, 273/108; 473/173, 174, 195
See application file for complete search history.

(56) References Cited

U.S. PATENT DOCUMENTS

| | | | | |
|---|---|---|---|---|
| 1,315,927 | A * | 9/1919 | Geib | 273/123 R |
| 2,211,330 | A | 8/1940 | Hochberg | |
| D123,540 | S | 11/1940 | Johnson | |
| 2,251,305 | A | 8/1941 | Tarbox | |
| 2,326,859 | A | 8/1943 | Hoover | |
| 2,472,719 | A | 6/1949 | Mysels | |
| 2,513,667 | A | 7/1950 | Olson | |
| 2,541,266 | A | 2/1951 | Metz | |
| 2,553,155 | A | 5/1951 | Warren | |
| D171,736 | S | 3/1954 | Stach | |
| 2,704,212 | A | 3/1955 | Dunseith | |
| 2,724,594 | A | 11/1955 | Anderson | |
| 2,806,701 | A | 9/1957 | Durant | |
| 2,863,666 | A * | 12/1958 | Aronson | 273/108 |
| 2,866,275 | A * | 12/1958 | Schuyler | 434/327 |
| 2,926,914 | A | 3/1960 | Miller | |
| 2,926,915 | A | 3/1960 | Johns | |
| 2,977,429 | A | 3/1961 | Zimmerman | |
| 3,070,372 | A * | 12/1962 | Brinati et al. | 473/180 |
| 3,092,387 | A | 6/1963 | Wagner | |
| 3,117,787 | A | 1/1964 | Stutzke | |
| 3,193,292 | A | 7/1965 | Mehelich | |
| 3,207,515 | A | 9/1965 | Mireider | |
| 3,231,277 | A | 1/1966 | Holland | |
| 3,403,907 | A | 10/1968 | Keller | |
| D220,349 | S * | 3/1971 | Holt | D21/342 |
| 3,628,793 | A | 12/1971 | Mudloff | |
| 3,683,514 | A | 8/1972 | Hughes | |
| 3,761,090 | A | 9/1973 | Nelson | |
| 3,781,011 | A | 12/1973 | Barlow | |
| 3,794,324 | A | 2/1974 | Moé | |

(Continued)

*Primary Examiner*—Raleigh W. Chiu
(74) *Attorney, Agent, or Firm*—Hodgson Russ LLP

(57) ABSTRACT

The invention may be embodied as a playing surface. Such a playing surface may include a first boundary wall, a second boundary wall, a first zone separator and a second zone separator. The second zone separator may be spaced apart from the first zone separator in order to provide a first zone area residing between the first zone separator and the second zone separator. The zone separators may each have an angled surface which are positioned so that a sphere may be rolled toward the angled surface of the zone separator, roll over the zone separator and into a zone area.

47 Claims, 8 Drawing Sheets

U.S. PATENT DOCUMENTS 3,891,213 A 6/1975 Cooper et al.
3,912,272 A * 10/1975 Hicks et al. ..... 273/119 R
3,941,381 A 3/1976 Trbovich
D242,557 S 11/1976 Lohr et al.
4,019,739 A 4/1977 Waite
4,023,804 A 5/1977 Lohr et al.
4,032,149 A 6/1977 Lansberry
4,087,091 A 5/1978 DeLorge
4,171,134 A 10/1979 Reck
4,171,812 A 10/1979 Marsin
4,198,050 A 4/1980 Goldfarb et al.
4,204,682 A 5/1980 Brown
4,239,221 A 12/1980 Griffin
4,320,902 A 3/1982 Florkey
4,323,250 A 4/1982 Lansberry
4,343,470 A 8/1982 Grifhorst
D269,358 S 6/1983 Barlow
4,460,177 A 7/1984 Slayton
4,498,675 A 2/1985 Jones
4,540,181 A 9/1985 Nelson
D281,084 S 10/1985 Norton
4,767,117 A 8/1988 Maio
4,840,375 A 6/1989 Lawlor et al.
4,877,256 A 10/1989 Falloon
4,909,517 A 3/1990 Furlong
4,938,485 A 7/1990 Hockridge et al.
4,974,858 A 12/1990 Knowlton
5,029,863 A * 7/1991 Krawczyk et al. ..... 273/125 R
5,031,919 A 7/1991 Dixon
D321,214 S 10/1991 Olson et al.
5,069,441 A 12/1991 Fang
5,069,460 A 12/1991 Kulesza
5,096,191 A 3/1992 Fang
5,123,656 A 6/1992 Green
5,320,360 A 6/1994 St. Pierre
5,332,230 A 7/1994 Benedict
5,333,879 A 8/1994 Barnes
D353,431 S 12/1994 Yager et al.
5,382,028 A 1/1995 Sciandra et al.
5,443,259 A 8/1995 Segan et al.
5,516,102 A * 5/1996 Polk et al. ..... 273/119 R
D375,125 S 10/1996 Mallek et al.
5,575,480 A 11/1996 Wehr
5,611,541 A 3/1997 Paino
D382,601 S 8/1997 Antill
D385,610 S 10/1997 McDonald
5,704,612 A 1/1998 Kelly et al.
D392,333 S 3/1998 Griggle
5,749,575 A 5/1998 German
5,769,424 A 6/1998 Kelly et al.
5,839,724 A * 11/1998 Bunac, Jr. ..... 273/127 R
D429,303 S 8/2000 Peterson, Jr.
6,173,957 B1 1/2001 James, Sr.
D437,626 S 2/2001 Chang
6,502,819 B2 1/2003 Rieber et al.
6,626,678 B2 9/2003 Forbes et al.
2002/0006763 A1 1/2002 Forbes et al.
2002/0098899 A1 7/2002 Newcomb et al.
2004/0029088 A1 2/2004 Forbes et al.
2006/0066042 A1 * 3/2006 DiFrancesco ..... 273/118 R

* cited by examiner

PLAYING SURFACE FOR A GAME AND METHOD OF USING A GAME PLAYING SURFACE

CROSS-REFERENCE TO RELATED APPLICATION

This application claims the benefit of priority to U.S. provisional patent application Ser. No. 60/614,536, filed on Sep. 30, 2004.

FIELD OF THE INVENTION

The present invention relates to playing surfaces for games. In particular, the invention relates to games in which a game piece is propelled at the playing surface, and points are awarded based on where the game piece lands.

BACKGROUND OF THE INVENTION

Game playing surfaces exist in the prior art. For example, U.S. Pat. No. 3,761,090 discloses a bowling target for use in a bowling game. The bowling target has a groove in which a ball may roll and rest. A slight ramp is placed before the front portion of the groove to deflect the ball over that portion of the groove, into the central area of the target face, where a concave recess in the center of the target face will retain a ball which barely rolls into the recess. Such games may not be challenging enough for frequent game players.

SUMMARY OF THE INVENTION

The present invention may be embodied as a playing surface. Such a playing surface may include a first boundary wall, a second boundary wall, a first zone separator and a second zone separator. The second zone separator may be spaced apart from the first zone separator in order to provide a first zone area residing between the first zone separator and the second zone separator. The zone separators may each have an angled surface which are positioned so that a sphere may be rolled toward the angled surface of the zone separator, roll over the zone separator and into a zone area.

BRIEF DESCRIPTION OF THE DRAWINGS

For a fuller understanding of the nature and objects of the invention, reference should be made to the accompanying drawings and the subsequent description. Briefly, the drawings are.

FURTHER DESCRIPTION OF THE INVENTION

Figure 1:
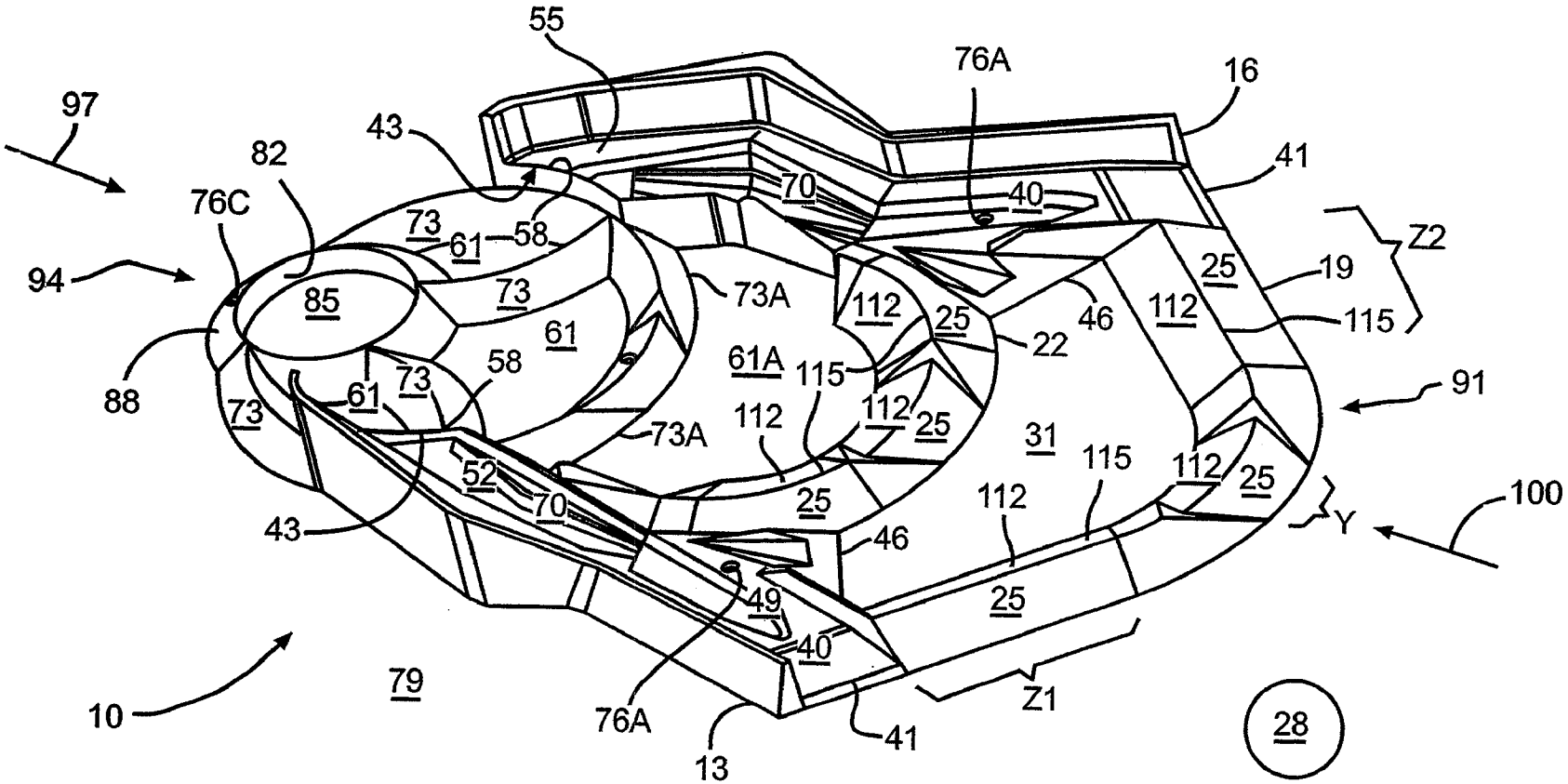
FIG. 1, which is a perspective view of a device according to the invention.
Figure 2:
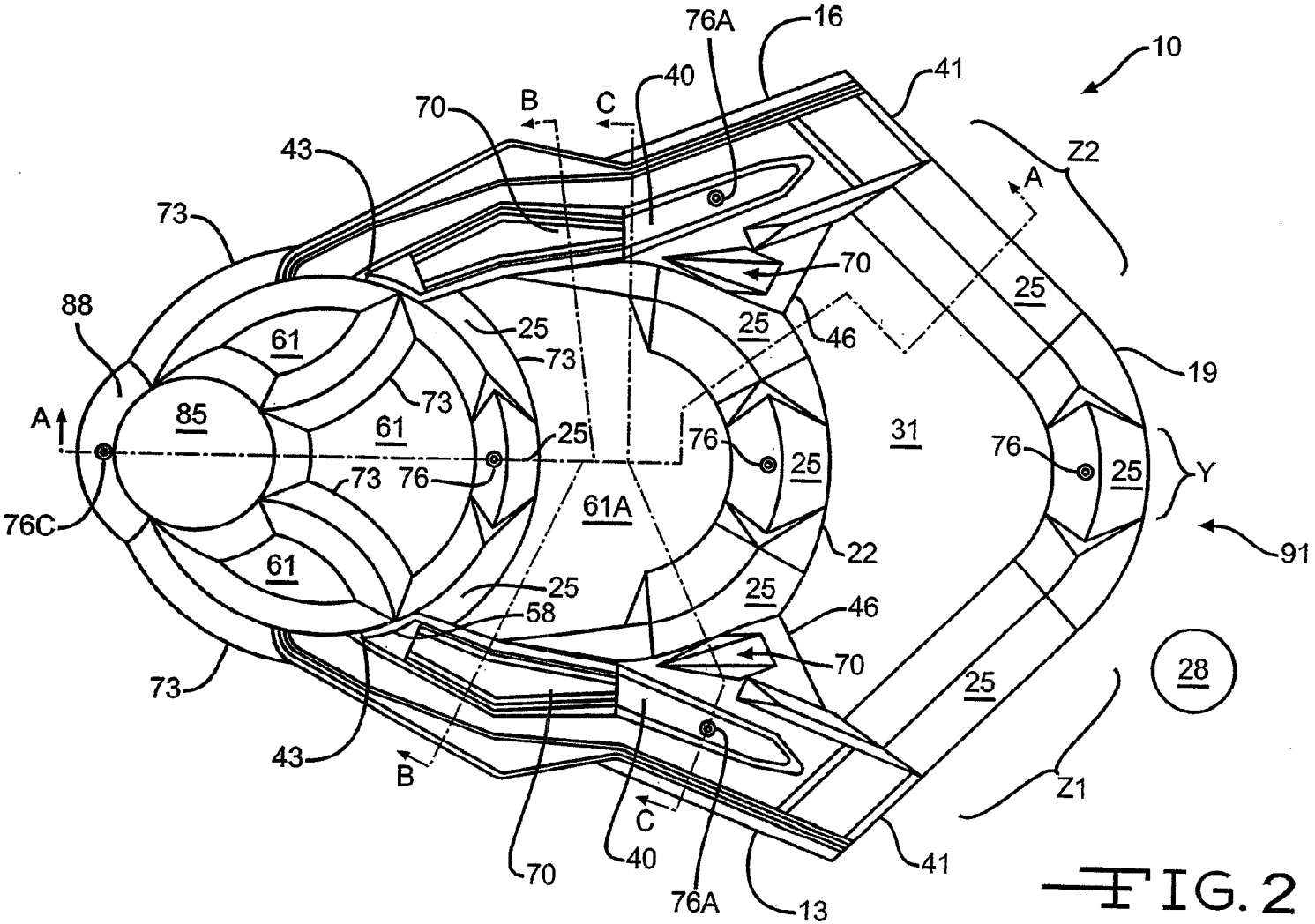
FIG. 2, which is a top view of the device depicted in FIG. 1.
Figure 3:
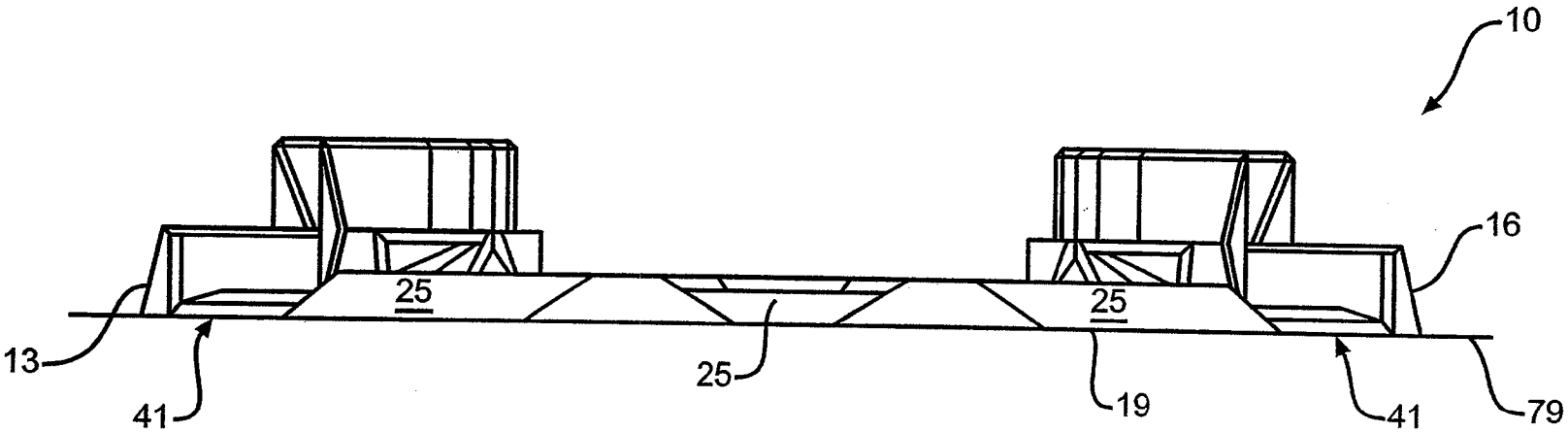
FIG. 3, which is a front view of the device depicted in FIG. 1.
Figure 4:
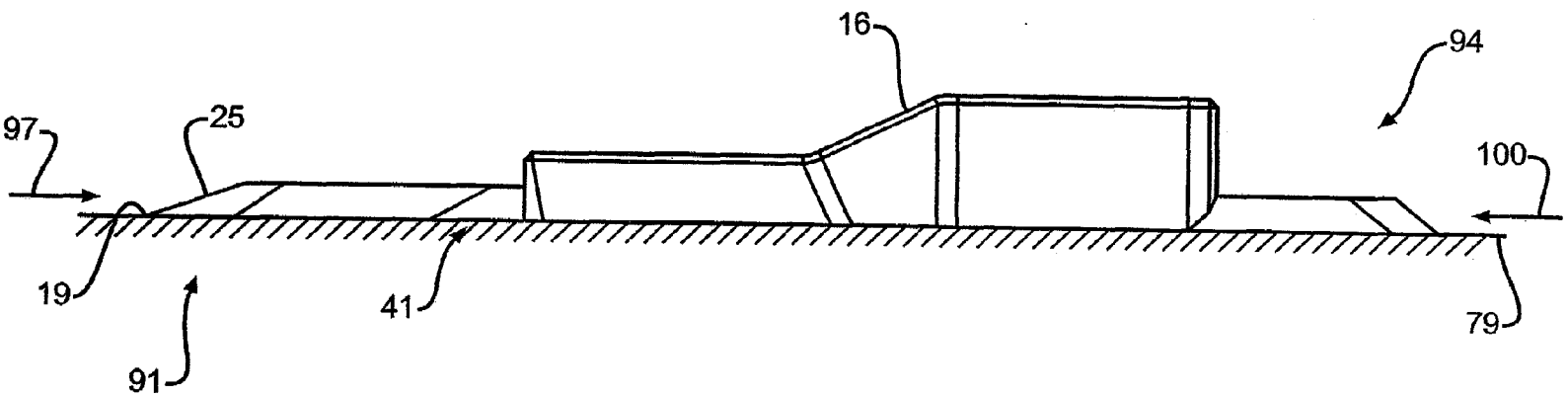
FIG. 4, which is a right side view of the device depicted in FIG. 1.
Figure 5:
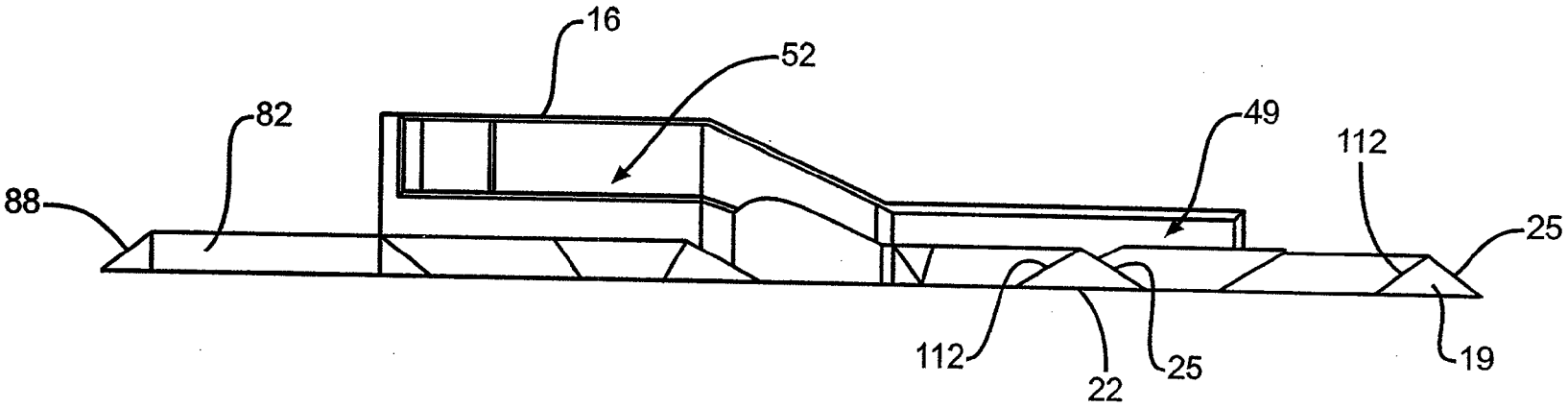
FIG. 5, which is a cross sectional view of the device depicted in FIG. 1, taken along the line A—A shown in FIG. 2.
Figure 6:
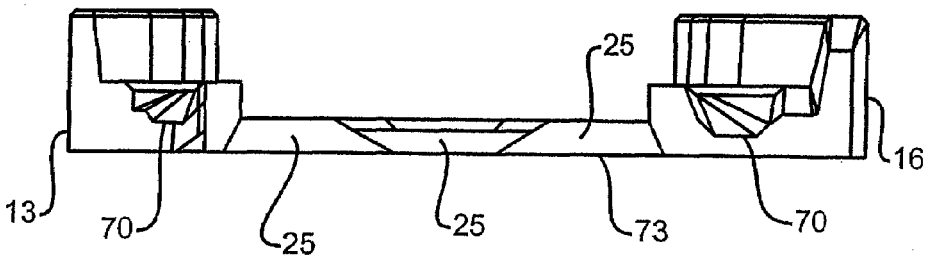
FIG. 6, which is a cross sectional view of the device depicted in FIG. 1, taken along the line B—B shown in FIG. 2.
Figure 7:
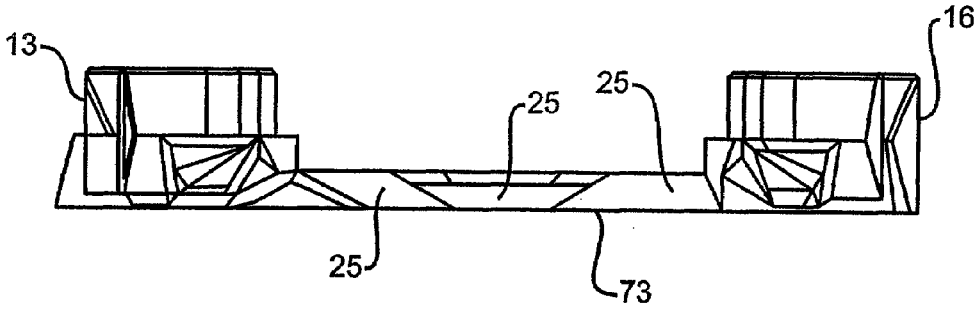
FIG. 7, which is a cross sectional view of the device depicted in FIG. 1, taken along the line C—C shown in FIG. 2.

An embodiment of the invention may include a playing surface 10 having a first boundary wall 13, a second boundary wall 16, a first zone separator 19 and a second zone separator 22. Such an embodiment is depicted in FIGS. 1 through 7. The first zone separator 19 may extend between the first boundary wall 13 and the second boundary wall 16, and may have an angled surface 25. The second zone separator 22 may be spaced apart from the first zone separator 19 in order to present a first zone area 31 residing between the first zone separator 19 and the second zone separator 22. The second zone separator 22 may extend between the first boundary wall 13 and the second boundary wall 16, and may have an angled surface 25. As used herein, the term "angled" is used to mean an angle between 5 degrees and 75 degrees measured from a substantially flat playing substrate 79.

The angled surfaces 25 may be sloped to inhibit but not prevent a game piece 28 from traversing the zone separators 19, 22. The angled surfaces 25 of the zone separators 19, 22 may be positioned so that a spherical game piece 28, such as a tennis ball, may be rolled toward the angled surface 25 of the first zone separator 19, roll over the first zone separator 19 into the first zone area 31, and be inhibited but not prevented, from leaving the first zone area 31 by the second zone separator 22. Similarly, if a spherical game piece 28 is rolled toward the second zone separator as part of an attempt to place the game piece 28 in the first zone area 31, the game piece 28 may roll over the second zone separator 22 into the first zone area 31, and be inhibited but not prevented, from leaving the first zone area 31 by the first zone separator 19. In this fashion, the angled surfaces 25 of the zone separators 19, 22, 73 may be positioned so that a spherical game piece 28 that is rolled toward one of the angled surfaces 25 of one of the zone separators 19, 22, 73 must traverse that zone separator 19, 22, 73 in order to access a zone area 31, 61, 61A, 85, and while traversing that zone separator 19, 22, 73, the sphere is in rolling contact with that zone separator 19, 22, 73, and the sphere may be inhibited but not prevented from leaving the zone area 31, 61, 61A by another of the zone separators 19, 22, 73 that defines a boundary of the zone area.

Figure 8:
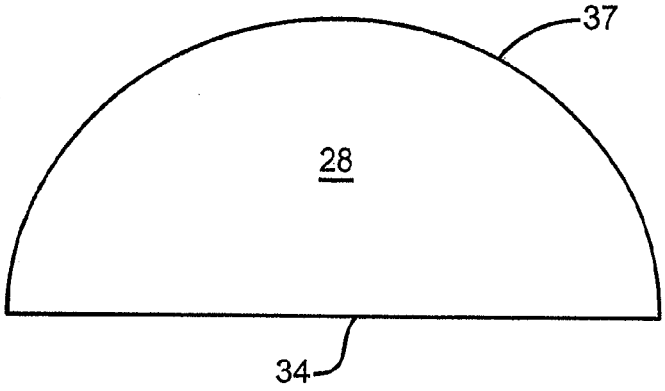
FIG. 8, which depicts a bean bag game piece according to the invention.

It should be noted that although features of the playing surface 10 are described with regard to a spherical game piece 28, the playing surface 10 may be used with game pieces 28 having different shapes. For example, another type of game piece 28 is a bean bag having a shape shown in FIG. 8. The bean bag in FIG. 8 has a substantially flat edge 34 and a curvilinear edge 37, which has been found to provide a bean bag that is easily held and may provide greater control in throwing the bean bag toward a desired location on the playing surface 10.

A ramp 40 may be provided in one or both of the boundary walls 13, 16. A first entrance 41 to the ramp 40 may be provided proximate to the first zone separator 19. A forward exit 43 from the ramp 40 may be provided distal from the first zone separator 19. Proximate to the forward exit 43, there may be a substantially horizontal region 55 on which a game piece 28 may stall while the game is played. The ramp 40 may include a blocking ledge 58 at the forward exit 43. Such a blocking ledge 58 may make it more likely that a game piece 28 will become stalled on the substantially horizontal region 55. A subsequent game piece 28 rolling up the ramp 40 toward the forward exit 43 may contact the stalled game piece 28 and push the stalled game piece 28 toward the forward exit 43. Upon leaving the ramp 40 via the forward exit 43, a game piece 28 may land in one of several other zone areas 61. A second entrance 46 to the ramp 40 may be provided in the region of the first zone area 31. The second entrance 46 may allow game pieces 28 to roll from the first zone area 31 onto the ramp 40.

If a game piece 28 does not have enough energy to reach the forward exit 43 and does not stall on the substantially horizontal region 55, the game piece 28 may roll down the ramp 40 and off the playing surface 10 via the first entrance 41, or into the first zone area 31 via the second entrance 46.

If desired, other ramp exits may be provided in the ramp 40 to allow a game piece 28 to exit the ramp 40 at a location other than the forward exit 43, for example an exit may be provided to allow a game piece 28 to exit the ramp in one or more of the zone areas 31, 61.

The ramp 40 may have a first elevation 49 in the vicinity of the first zone separator 19 and a second elevation 52 in the vicinity of the second zone separator 22. The first elevation 49 may be different from the second elevation 52, for example, the first elevation 49 may be lower than the second elevation 52 so that if a game piece 28 is rolled toward the ramp 40, the elevation of the game piece 28 will increase as the game piece 28 moves along the ramp 40 toward the forward exit 43.

Channels 70 may be included in the ramp 40. Such channels 70 may influence how a game piece 28 traverses the ramp 40, and the channels 70 may be sized in width so that game pieces 28 having different diameters may move along the ramp 40 differently. Such an arrangement may make playing the game more or less challenging depending on the size of the game piece 28.

At least one of the zone separators 19, 22, 73 may have a hole 76 through which a screw may be inserted in order to secure the playing surface 10 to a playing substrate 79. For example, the playing substrate 79 may be a lawn. The ramps 40 may be provided with a hole 76A, which may accept a screw in order to secure the playing surface 10 to the playing substrate, or which may be used to drain water from the ramps 40.

The angled surface 25 of one or more of the zone separators 19, 22, 73 need not have a constant slope. For example, the slope of the first zone separator 19 is shown substantially constant in the regions identified by "Z1" and "Z2", but the slope is different in the centrally located region identified by "Y". The Y region has less of a slope, and may provide easier access to the first zone area 31 should a game piece 28 be rolled toward the Y region. In this manner, less energy may be needed for a game piece 28 to roll over the first zone separator 19 via the Y region, through the first zone area 31, over the second zone separator 22, through a second zone area 61A, over a third zone separator 73A and into a third zone area 61B. Although it may be possible to roll through all three zone areas 31, 61A, 61B by traversing the zone separators 19, 22, 73 in the regions having the greatest slope, playing surface 10 may require the game piece 28 to have more energy to do so. Further, in traversing the zone separators 19, 22, 73, the game piece 28 may be deflected by one or more of the zone separators 19, 22, 73 toward a boundary wall 13, 16, for example, if the angle of attack for the game piece 28 does not result in the game piece 28 traversing the zone separator 19, 22, 73 along the shortest distance.

Other types of zone areas 61 may be included in the playing surface 10. One such other zone area 61 may be defined by a separator 82 having substantially vertical walls (relative to the playing substrate 79) in order to define an interior cup zone area 85. Such a cup zone area 85 may be used to simulate the cup of a golf course into which a golf ball may be caused to roll. An exterior surface 88 of such a cup zone separator 82 may be angled to facilitate a golf ball rolling over the cup zone separator 82 and into the cup zone area 85.

The cup zone area 85 may be located on a first extreme end 91 of the playing surface 10, and the first zone separator 19 may be located on a second extreme end 94 of the playing surface 10. In this manner, the playing surface 10 may be utilized from different directions. In a first one of the directions 97, the cup zone area 85 would be proximate to a player and in this arrangement, the playing surface 10 may be easily used by a player to practice putting. It will be recognized that when the playing surface is played in the first direction, the ramps 40 will not easily accept a game piece 28 rolling toward the playing surface 10. In a second one of the directions 100, the playing surface 10 may be used to play a game that is described below, and in this second direction 100, the ramps 40 will easily accept a game piece 28 rolling toward the playing surface 10. It will be recognized that if a game piece 28 is propelled with enough force toward the playing surface 10, the game piece 28 may traverse the playing surface 10 from the first extreme end 91 to the second extreme end 94, or from the second extreme end 94 to the first extreme end 91, depending on the direction 100, 97 in which play is occurring.

Figure 9A:
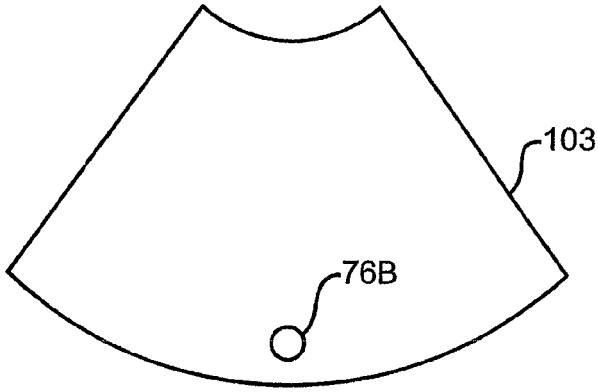
FIG. 9A, which is a top view
Figure 9B:
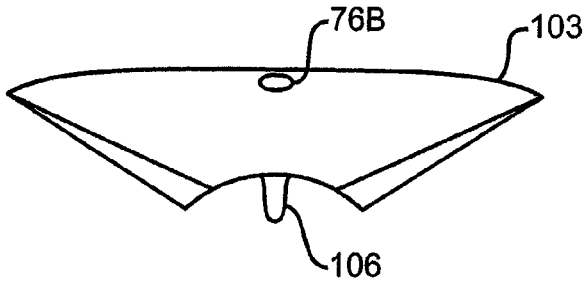
FIG. 9B is a front view of a putting ramp, which may be used with the device depicted in FIG. 1.

In an embodiment of the invention, a putting ramp 103 may be used to facilitate a golf ball rolling into the cup zone area 85. FIGS. 9A and 9B depict one such putting ramp. The putting ramp 103 may have a hole 76B, which may accept a screw in order to secure the putting ramp 103 to the playing substrate 79. The putting ramp 103 may include a peg 106 which is sized to fit into a hole 76C on the playing surface 10, and thereby secure the putting ramp 103 to the playing surface 10.

The first zone separator 19 may include a slanted surface 112 that extends between the first boundary wall 13 and the second boundary wall 16. The slanted surface 112 and the angled surface 25 may meet to form a ridge 115. In this arrangement, a game piece 28 that expends kinetic energy to traverse an angled surface 25 may recover much of that kinetic energy as it rolls down the slanted surface 112. Similarly, if the game is played from a different direction, a game piece 28 that expends kinetic energy to traverse a slanted surface 112 may recover much of that kinetic energy as it rolls down the angled surface 25.

The playing surface 10 may be made from a buoyant material, such as styrofoam, or may be supported by floatation devices. Such a playing surface 10 may be used in a swimming pool. In one such embodiment of the invention, the zone areas 31, 61, 85 may be open areas which partially fill with water.

Figure 10:
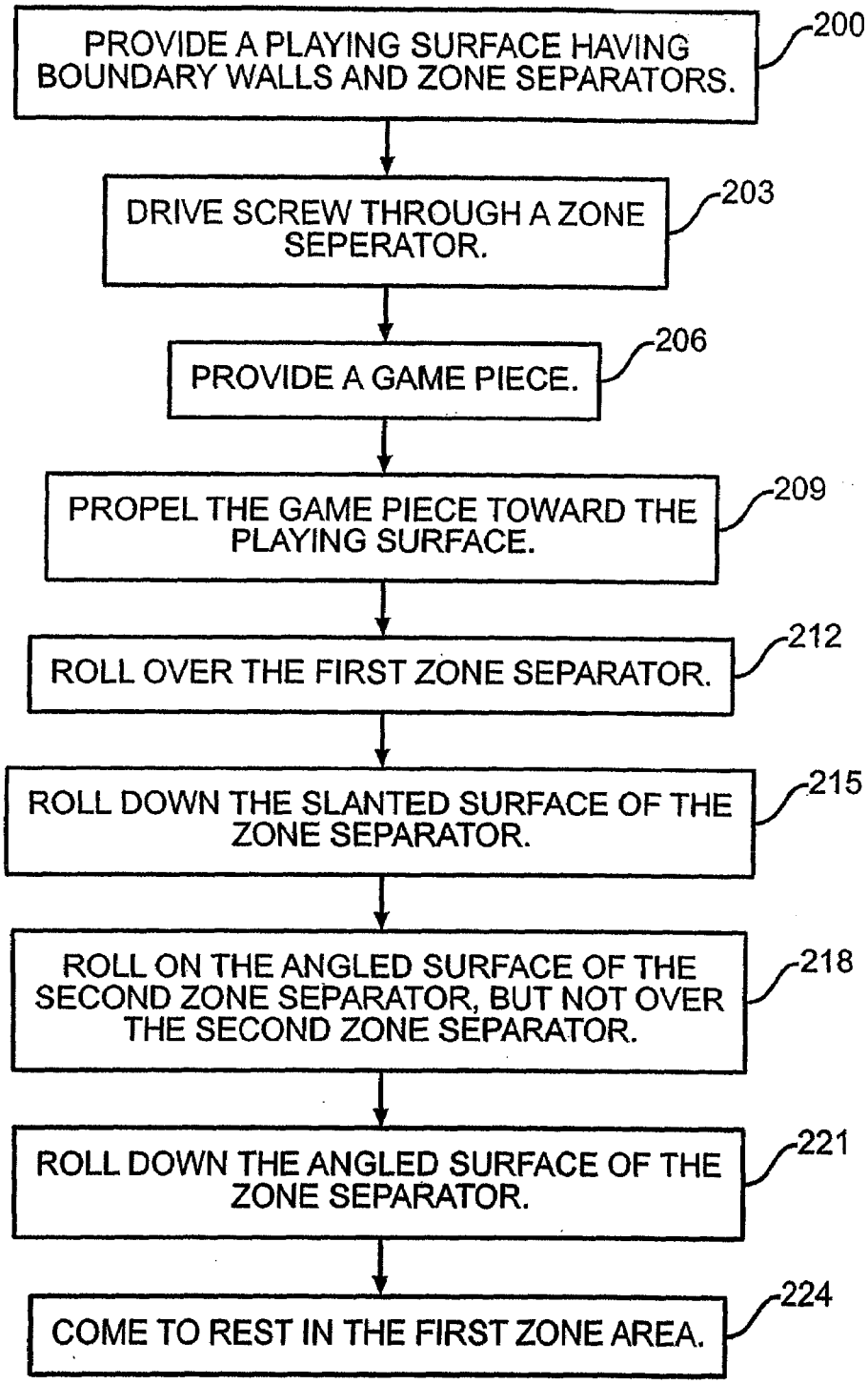
FIG. 10, which depicts steps of a method according to the invention.

The invention may include a method of playing a game. FIG. 10 depicts steps according to such a method, which may include providing 200 a playing surface, such as the one depicted in FIGS. 1 through 7. For example, the playing surface may have (a) a first boundary wall, (b) a second boundary wall, (c) a first zone separator extending between the first boundary wall and the second boundary wall, the first zone separator having an angled surface, and (d) a second zone separator extending between the first boundary wall and the second boundary wall, the second zone separator having an angled surface, the second zone separator being spaced from the first zone separator in order to present a first zone area residing between the first zone separator and the second zone separator. A screw may be driven 203 through one or more of the zone separators and into a playing substrate in order to secure the playing surface to the playing substrate.

A game piece may be provided 206, for example, a substantially spherical ball may be provided. The game piece may be propelled 209 toward the playing surface, for example the game piece may be rolled toward the playing surface so that the game piece rolls 212 over the angled surface of the first zone separator.

The game piece may roll 215 down the first zone separator, and roll 218 on the angled surface of the second zone separator, but not over the second zone separator. In such a situation, the game piece may roll down 221 the angled surface of the second zone separator and come to rest 224 in the first zone area.

Points may be awarded based on where the game piece rests 224 at the end of play. For example, one point may be awarded if the game piece rests in the first zone area, two points if the game piece rests in the second zone area and three points if the game piece rests in a third zone area. If two people are playing against each other, the game may be played by throwing all the game pieces at the playing surface, tallying the points of each player based on where game pieces of each player rest, and then awarding the difference in point tallies to that player with the most points.

U.S. provisional patent application Ser. No. 60/614,536 includes descriptions of embodiments of the invention. U.S. provisional patent application Ser. No. 60/614,536 is hereby incorporated by reference.

Although the present invention has been described with respect to one or more particular embodiments, it will be understood that other embodiments of the present invention may be made without departing from the spirit and scope of the present invention. Hence, the present invention is deemed limited only by the appended claims and the reasonable interpretation thereof.

What is claimed is:

1. A playing surface, comprising:

a first boundary wall, which includes a ramp having a first elevation in the vicinity of the first zone separator and a second elevation in the vicinity of the second zone separator, wherein the first elevation is different from the second elevation, and the ramp includes an exit distal from the first zone separator;

a second boundary wall;

a first zone separator extending between the first boundary wall and the second boundary wall, the first zone separator having an angled surface that is sloped to inhibit but not prevent a game piece from traversing the first zone separator;

a second zone separator extending between the first boundary wall and the second boundary wall, the second zone separator having an angled surface that is sloped to inhibit but not prevent a game piece from traversing the second zone separator, the second zone separator being spaced from the first zone separator in order to present a first zone area residing between the first zone separator and the second zone separator;

the angled surfaces of the zone separators being positioned so that a sphere that is rolled toward the angled surface of one of the zone separators must traverse that zone separator in order to access the first zone area, and while traversing that zone separator the sphere is in rolling contact with that zone separator, and the sphere is inhibited but not prevented from leaving the first zone area by the other of the zone separators.

2. The playing surface of claim 1, wherein the ramp includes an entrance proximate to the first zone separator.

3. The playing surface of claim 1, wherein the ramp includes a substantially horizontal region proximate to the exit.

4. The playing surface of claim 1, wherein at least one of the zone separators has a hole therethrough, which may accept a screw in order to attach the playing surface to a playing substrate.

5. The playing surface of claim 1, wherein the angled surface of the first zone separator does not have a constant slope.

6. The playing surface of claim 5, wherein the angled surface in a centrally located region of the first zone separator has a slope that is less than a slope of regions which are not centrally located.

7. The playing surface of claim 1, further comprising a third zone separator having substantially vertical walls defining an interior cup zone area.

8. The playing surface of claim 7, wherein the third zone separator has an angled exterior surface.

9. The playing surface of claim 7, wherein the cup zone area is on a first extreme end of the playing surface, and the first zone area is on a second extreme end of the playing surface.

10. The playing surface of claim 1, wherein the first zone separator includes a slanted surface extending between the first boundary wall and the second boundary wall.

11. The playing surface of claim 10, wherein the slanted surface and the angled surface meet to form a ridge.

12. The playing surface of claim 1, wherein the playing surface is made from a buoyant material.

13. A playing surface, comprising:

a first boundary wall;

a second boundary wall;

a first zone separator extending between the first boundary wall and the second boundary wall, the first zone separator having an angled surface that is sloped to inhibit but not prevent a game piece from traversing the first zone separator, and wherein the angled surface of the first zone separator does not have a constant slope;

a second zone separator extending between the first boundary wall and the second boundary wall, the second zone separator having an angled surface that is sloped to inhibit but not prevent a game piece from traversing the second zone separator, the second zone separator being spaced from the first zone separator in order to present a first zone area residing between the first zone separator and the second zone separator;

the angled surfaces of the zone separators being positioned so that a sphere that is rolled toward the angled surface of one of the zone separators must traverse that zone separator in order to access the first zone area, and while traversing that zone separator the sphere is in rolling contact with that zone separator, and the sphere is inhibited but not prevented from leaving the first zone area by the other of the zone separators.

14. The playing surface of claim 13, wherein the first boundary wall includes a ramp having a first elevation in the vicinity of the first zone separator and a second elevation in the vicinity of the second zone separator, wherein the first elevation is different from the second elevation.

15. The playing surface of claim 14, wherein the ramp includes an entrance proximate to the first zone separator.

16. The playing surface of claim 14, wherein the ramp includes an exit distal from the first zone separator.

17. The playing surface of claim 16, wherein the ramp includes a substantially horizontal region proximate to the exit.

18. The playing surface of claim 13, wherein at least one of the zone separators has a hole therethrough, which may accept a screw in order to attach the playing surface to a playing substrate.

19. The playing surface of claim 13, wherein the angled surface in a centrally located region of the first zone separator has a slope that is less than a slope of regions which are not centrally located.

20. The playing surface of claim 13, further comprising a third zone separator having substantially vertical walls defining an interior cup zone area.

21. The playing surface of claim 20, wherein the third zone separator has an angled exterior surface.

22. The playing surface of claim 20, wherein the cup zone area is on a first extreme end of the playing surface, and the first zone area is on a second extreme end of the playing surface.

23. The playing surface of claim 13, wherein the first zone separator includes a slanted surface extending between the first boundary wall and the second boundary wall.

24. The playing surface of claim 23, wherein the slanted surface and the angled surface meet to form a ridge.

25. The playing surface of claim 13, wherein the playing surface is made from a buoyant material.

26. A playing surface, comprising:

a first boundary wall;

a second boundary wall;

a first zone separator extending between the first boundary wall and the second boundary wall, the first zone separator having an angled surface that is sloped to inhibit but not prevent a game piece from traversing the first zone separator;

a second zone separator extending between the first boundary wall and the second boundary wall, the second zone separator having an angled surface that is sloped to inhibit but not prevent a game piece from traversing the second zone separator, the second zone separator being spaced from the first zone separator in order to present a first zone area residing between the first zone separator and the second zone separator;

the angled surfaces of the zone separators being positioned so that a sphere that is rolled toward the angled surface of one of the zone separators must traverse that zone separator in order to access the first zone area, and while traversing that zone separator the sphere is in rolling contact with that zone separator, and the sphere is inhibited but not prevented from leaving the first zone area by the other of the zone separators;

a third zone separator having substantially vertical walls defining an interior cup zone area.

27. The playing surface of claim 26, wherein the first boundary wall includes a ramp having a first elevation in the vicinity of the first zone separator and a second elevation in the vicinity of the second zone separator, wherein the first elevation is different from the second elevation.

28. The playing surface of claim 27, wherein the ramp includes an entrance proximate to the first zone separator.

29. The playing surface of claim 27, wherein the ramp includes an exit distal from the first zone separator.

30. The playing surface of claim 29, wherein the ramp includes a substantially horizontal region proximate to the exit.

31. The playing surface of claim 26, wherein at least one of the zone separators has a hole therethrough, which may accept a screw in order to attach the playing surface to a playing substrate.

32. The playing surface of claim 26, wherein the angled surface of the first zone separator does not have a constant slope.

33. The playing surface of claim 32, wherein the angled surface in a centrally located region of the first zone separator has a slope that is less than a slope of regions which are not centrally located.

34. The playing surface of claim 26, wherein the third zone separator has an angled exterior surface.

35. The playing surface of claim 26, wherein the cup zone area is on a first extreme end of the playing surface, and the first zone area is on a second extreme end of the playing surface.

36. The playing surface of claim 26, wherein the first zone separator includes a slanted surface extending between the first boundary wall and the second boundary wall.

37. The playing surface of claim 36, wherein the slanted surface and the angled surface meet to form a ridge.

38. The playing surface of claim 34, wherein the playing surface is made from a buoyant material.

39. A method of playing a game, comprising:

providing a playing surface having (a) a first boundary wall, which includes a ramp having a first elevation in the vicinity of the first zone separator and a second elevation in the vicinity of the second zone separator, wherein the first elevation is different from the second elevation, and the ramp includes an exit distal from the first zone separator, (b) a second boundary wall, (c) a first zone separator extending between the first boundary wall and the second boundary wall, the first zone separator having an angled surface, and (d) a second zone separator extending between the first boundary wall and the second boundary wall, the second zone separator having an angled surface, the second zone separator being spaced from the first zone separator in order to present a first zone residing between the first zone separator and the second zone separator, providing a substantially spherical game piece;

rolling the game piece toward the playing surface, so that the game piece rolls over the angled surface of the first zone separator.

40. The method of claim 39, further comprising allowing the game piece to role on the angled surface of the second zone separator, but not over the second zone separator.

41. The method of claim 39, further comprising inserting a screw through the first zone separator and into a playing substrate.

42. A method of playing a game, comprising:

providing a playing surface having (a) a first boundary wall, (b) a second boundary wall, (c) a first zone separator extending between the first boundary wall and the second boundary wall, the first zone separator having an angled surface, wherein the angled surface of the first zone separator does not have a constant slope, and (d) a second zone separator extending between the first boundary wall and the second boundary wall, the second zone separator having an angled surface, the second zone separator being spaced from the first zone separator in order to present a first zone residing between the first zone separator and the second zone separator, providing a substantially spherical game piece;

rolling the game piece toward the playing surface, so that the game piece rolls over the angled surface of the first zone separator.

43. The method of claim 42, further comprising allowing the game piece to role on the angled surface of the second zone separator, but not over the second zone separator.

44. The method of claim 42, further comprising inserting a screw through the first zone separator and into a playing substrate.

45. A method of playing a game, comprising:

providing a playing surface having (a) a first boundary wall, (b) a second boundary wall, (c) a first zone separator extending between the first boundary wall and the second boundary wall, the first zone separator having an angled surface, (d) a second zone separator extending between the first boundary wall and the second boundary wall, the second zone separator having an angled surface, the second zone separator being spaced from the first zone separator in order to present a first zone residing between the first zone separator and the second zone separator, and (e) a third zone separator having substantially vertical walls defining an interior cup zone area;

providing a substantially spherical game piece;

rolling the game piece toward the playing surface, so that the game piece rolls over the angled surface of the first zone separator.

46. The method of claim 45, further comprising allowing the game piece to role on the angled surface of the second zone separator, but not over the second zone separator.

47. The method of claim 45, further comprising inserting a screw through the first zone separator and into a playing substrate.

* * * * *